US005964026A

United States Patent [19]

Taijonlahti et al.

[11] Patent Number: 5,964,026

[45] Date of Patent: Oct. 12, 1999

[54] SHEET METAL WORK CENTER AND METHOD THEREFOR OF FABRICATING WORKSHEETS

[75] Inventors: Jorma Taijonlahti, Yliharma; Mikael Ollikainen, Lappeenranta, both of Finland

[73] Assignee: Lillbacka Jetair Oy, Kauhava, Finland

[21] Appl. No.: 08/894,127

[22] PCT Filed: Nov. 19, 1996

[86] PCT No.: PCT/FI96/00625

§ 371 Date: Oct. 27, 1997

§ 102(e) Date: Oct. 27, 1997

[87] PCT Pub. No.: WO97/21503

PCT Pub. Date: Jun. 19, 1997

[30] Foreign Application Priority Data

Dec. 14, 1995 [FI] Finland ..... 955988

[51] Int. Cl.[6] ..... B23Q 7/00

[52] U.S. Cl. ..... 29/559; 83/131; 83/136; 83/138

[58] Field of Search ..... 72/21.2, 21.3, 72/407, 389, 456, 455; 83/131, 136, 138, 139; 29/559

[56] References Cited

U.S. PATENT DOCUMENTS

| | | | |
|---|---|---|---|
| 1,149,226 | 8/1915 | Stevenson | 83/131 |
| 2,123,683 | 3/1938 | Oeckl | 153/48 |
| 3,667,305 | 6/1972 | Rasoira | 74/818 |
| 4,387,583 | 6/1983 | Martin et al. | 72/22 |
| 4,646,599 | 3/1987 | Benedict | 83/131 |
| 4,672,831 | 6/1987 | Kogure et al. | 72/21 |
| 5,052,208 | 10/1991 | Sartorio | 72/407 |
| 5,077,998 | 1/1992 | Santorio | 72/21 |

FOREIGN PATENT DOCUMENTS

| | | |
|---|---|---|
| 91830 | 5/1994 | Finland . |
| 39 25 608 A1 | 2/1990 | Germany . |
| 34 34 470 C2 | 7/1994 | Germany . |

OTHER PUBLICATIONS

Japanese Abstract 57–195537 (Amanda K.K.), Dec. 1, 1992 (12/01/82), Fig. 1.

*Primary Examiner*—P. W. Echols
*Assistant Examiner*—John Hong
*Attorney, Agent, or Firm*—Louis Woo

[57] ABSTRACT

The invention relates to a sheet metal work center, in which a locking arrangement (15) is placed between the stationary part (9) of the buffer structure (2) and the releaser (13), wherein at least some of the vertical movements of the upper tool (7) and the releaser (13) can be implemented by using the transfer device (12), the stationary part (9) of the buffer structure (2) and the releaser (13) being connected with the locking arrangement (15).

14 Claims, 5 Drawing Sheets

SHEET METAL WORK CENTER AND METHOD THEREFOR OF FABRICATING WORKSHEETS

FIELD OF INVENTION

The invention relates to a method for working with a sheet metal work center according to the preamble of claim 1.

BACKGROUND OF INVENTION

Generally in sheet metal working technology, for example in sheet punching, certain components are always used. Such components include tools, punches, a releasing or stripper plate or a releaser, and a cushion or stopper. In sheet punching, the machining is conducted in a way that a punch is used to make a hole in a sheet against the cushion, and the punch is drawn out of the hole either by a spring force or by another force, wherein the releasing plate prevents the punched sheet to rise with the punch while maintaining the plate in its place. In sheet punching, there are two possibilities to conduct the machining: first, the releasing plate remains in contact with the sheet to be punched during each punching stroke; or second, there is a certain air gap between the material to be punched and the releasing plate. Each method has its advantages, i.e., when there is a contact with the plate at the punching stage, the plate will not vibrate during machining. On the other hand, when punching aluminium or materials which are soft or have a sensitive surface, the releasing force may become too great and leave scratches on the surface of the material. Because of this, it is preferred that both alternatives be available in a sheet metal work center. Thus the releaser plate could be kept in place during the punching strokes to achieve a permanent air gap, or the releaser plate could touch the material with every punching stroke.

Known sheet metal work centers use a single-tool system having a buffer or ram assembly, to which the drift or tool is mechanically fixed, wherein it can be exchanged, if necessary, either manually, by a robot or with a manipulator, and a releaser plate, wherein both are controlled with a separate pressurized medium cylinder arrangement. This kind of solution involves, however, the problem that two separate shaft systems are required for controlling the pressurized medium, and these must be synchronized with an NC control unit. This tends to delay the working process. The single-tool system is relatively fast in the so-called passive mode, wherein the releaser, usually a releaser plate, is stationary at the distance of an air gap from the sheet to be worked during the punching stroke. Thus the buffer, with the drift, can conduct punching strokes even at very short intervals. The problem is present particularly when the so-called active mode is used, wherein the releaser plate is placed in contact with the surface of the sheet to be worked. Thus a need for so-called serial control arises, wherein the implementation of the NC control unit requires first the information that the releaser plate is in contact with the surface of the sheet to be worked before the buffer can be given a punching command. This fact will cause a delay of about one third in the working process when moving from the passive mode to the active mode.

SUMMARY OF INVENTION

With the present invention, it is possible to implement the working process substantially at the same working speed irrespective of whether the active or passive mode is used, i.e., whether the releaser plate is at a distance of an air gap from the sheet to be worked or in contact with said plate. Using the solution of the invention, the above-mentioned working operations can be conducted with so-called one-shaft control. The purpose of the invention is thus to raise the standard of prior art and to present new surprising solutions for making the operations of sheet metal work centres more efficient and varied.

The invention is also related to a sheet metal work center.

BRIEF DESCRIPTION OF THE DRAWINGS

The invention will be described in more detail in the following description with reference to the embodiment shown in the appended drawings, wherein.

DETAILED DESCRIPTION OF THE INVENTION

Figure 1:
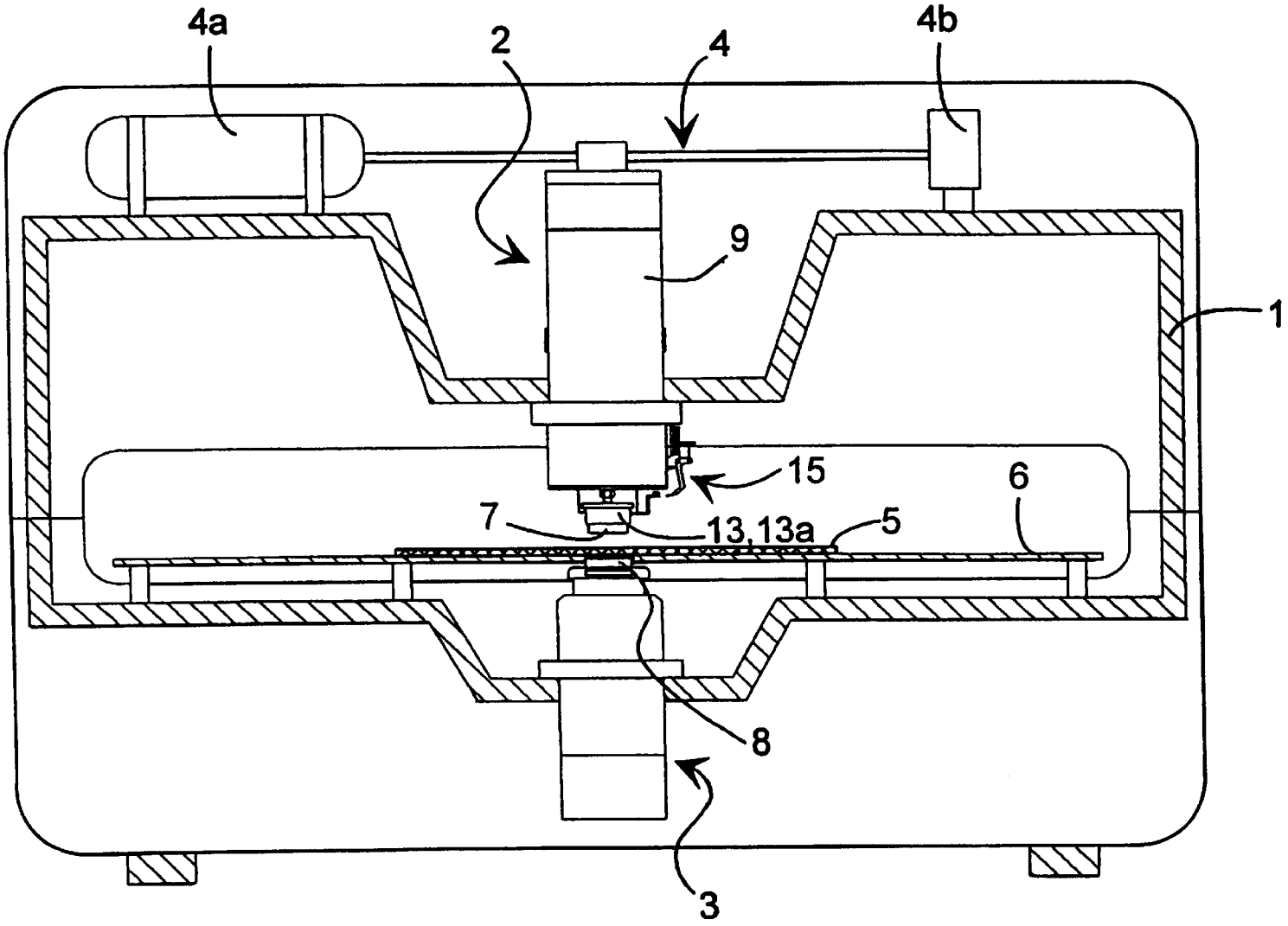
FIG. 1 is a schematic general view of a sheet metal work center according to the invention, shown in a vertical section.

With reference to FIG. 1, the reference numeral 1 indicates the machine body of the sheet metal work center, having a buffer or punch structure 2 placed in its upper part and a stopper structure 3 placed in its lower part. The machine body has either a closed, circumferential O-structure or an open structure having e.g. a C-, J-form or the like. FIG. 1 shows also equipment related to the transfer device of the buffer indicated with the reference numeral 4, such as a hydraulic accumulator 4*a* and a valve block 4*b*. The sheet 5 to be worked is placed onto the machining level or worktable 6, underneath the upper tool or drift 7 and the releaser or stripper plate 13 and above the lower tool die or stopper 8 in the stopper structure 3 between releaser 13, upper tool 7 and lower tool 8. The sheet metal work center can be used for working at least the following operations: punching, forming, screwing, and other generally known working operations to be conducted with a sheet metal work center. Normally, the upper tool 7 of the buffer structure 2 conducts the sheet punching operations with a downwards directed working movement. Alternatively, the lower tool 8 can be used for forming, wherein the working direction of the forming lower tool 8 is from below upwards. In FIG. 1, the reference numeral 15 indicates a locking arrangement for locking the releaser 13, when necessary in situations to be described in more detail below, to be stationary with the buffer fixing body 9.

FIG. 2 shows steps a to e illustrating schematically some work stages to be conducted with the sheet metal work center. A punch stroke indicates in this context the work cycle of the buffer 10 and the upper tool 7, including the working operation and the return movement to the starting position.

Figures 2A, 2B, 2C, 2D, 2E:
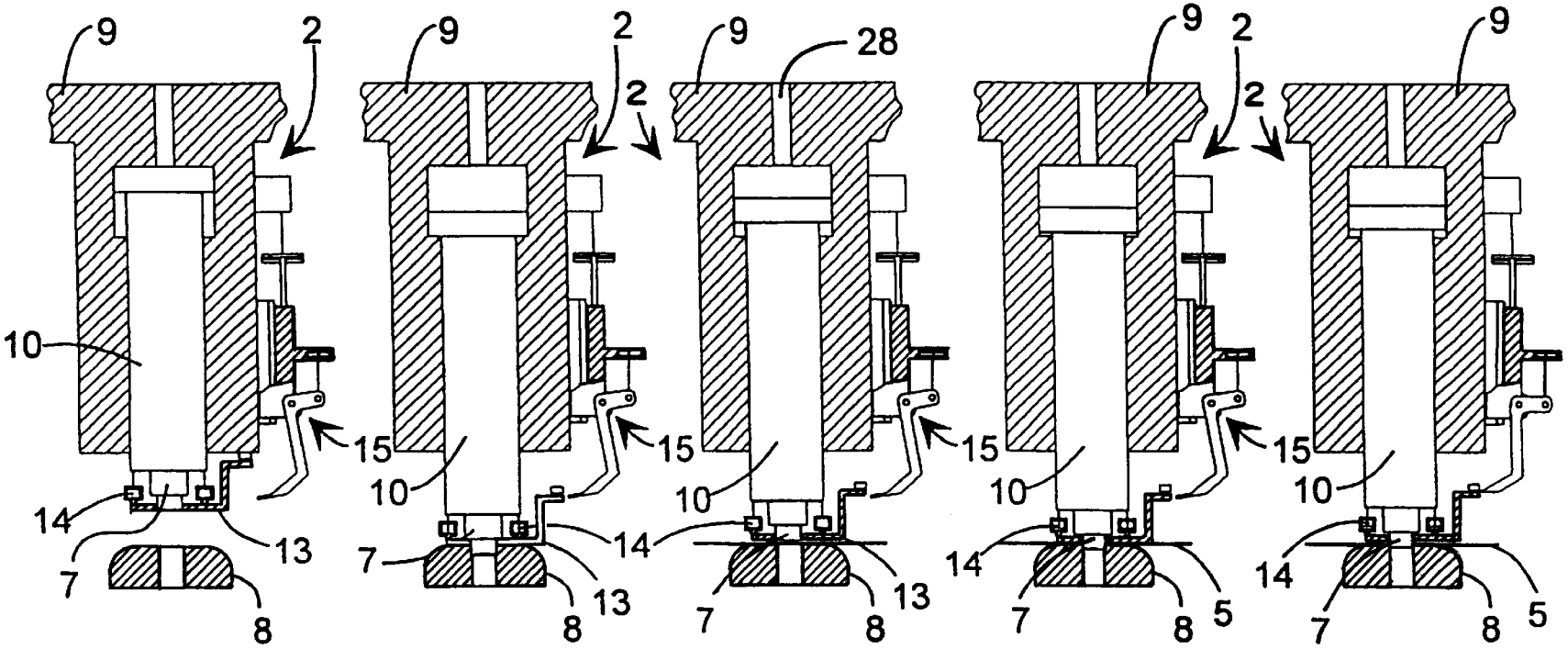
FIG. 2 is a schematic illustration of the principle of the invention, shown in steps a to e, with the buffer structure according to the first embodiment.

FIG. 2*a* shows the buffer structure 2 and the stopper structure 3 in the tool exchange position, in which the upper tool 7 is exchanged in the buffer structure 2. The buffer structure 2 comprises as main parts a buffer fixing body 9, at which the buffer structure 2 is fixed to the machine body 1. Further, the buffer or chamber structure 2 comprises the buffer 10. Furthermore, the lower part of the buffer structure 2 is provided with the upper tool 7 and the releasing plate or releaser 13 surrounding the upper tool 7 and being connected with the releaser 13 by means of the transfer device 14 of the releaser 13.

A punching cylinder 12 used as the transfer device of the buffer 10 is effective between the buffer 10 and the buffer fixing body 9, placed in the upper part of the buffer 10.

FIG. 2*b* shows the punching cylinder 12 in the lowest possible position, that is, the punch stroke has been conducted without sheets 5. FIG. 2*c* shows a starting situation for a punch stroke, wherein the buffer 10 is moved in connection with the sheet 5 in a way that the upper tool 7 and the releaser 13 are at the distance of air gap 19 from the upper surface of the sheet 5. Thus the working levels of the upper tool 7 and the releaser 13 are substantially at the same level. At this stage, the control unit of the sheet metal work center can be used to select between a so-called passive punch stroke, wherein the releaser 13 remains at the distance of said air gap 19 (cf. FIG. 5) from the sheet 5, retained in this position with a locking arrangement 15, and a so-called active punch stroke, wherein the releaser 13 is brought into contact with the upper surface of the sheet 5. The operations related to this selection will be described in more detail with particular reference to FIGS. 4 and 5.

FIG. 2*d*, in turn, shows the step of conducting an active punch stroke, wherein the locking arrangement 15 in connection with the buffer 10 effective between the releaser 13 and the fixing body 9, is open (as well as at the preceding steps 2*a* to 2*c*), wherein the combination of the buffer 10 and the means 7, 13, 14 is moved downwards by the punching cylinder 12 used as the transfer device of the buffer 10. When the releaser 13 meets the surface of the sheet 5, the releaser transfer devices 14 yields in the longitudinal direction of the buffer 10, although generating a counterforce against sheet 5 at the end of the buffer 10. One function of the transfer or cushion device 14 of the releaser 13 is particularly to generate a controllable releasing force. FIG. 2*d* shows a situation in which the upper tool 7 has punched the sheet 5, penetrating underneath the upper surface of the lower tool 8 of the stopper structure 3 within the limits of the adjustable stroke length.

FIG. 2*e* shows the step of a passive punching stroke, wherein the releaser 13 is locked to be stationary in relation to the buffer 10 fixing body 9 by means of the locking arrangement 15, wherein the releaser 13 is kept in place to maintain the distance of air gap 19 (cf. FIG. 5) to the sheet 5. The buffer 10, with the upper tool 7 fixed in it, conducts a working movement downwards in relation to the buffer fixing body 9.

In an advantageous manner, the buffer structure 2 is substantially a cylindrical form piece, wherein the buffer fixing body 9 comprises a central hole, which holds the buffer 10 with a primarily rod-like structure and the punching cylinder 12 used as the transfer device in the upper part thereof. Parts 9, 10 and 15 comprise constructive elements which can be used to constitute the embodiment of the buffer structure 2 using pressurized medium, particularly hydraulic fluid.

Figures 3A, 3B, 3C, 3D:
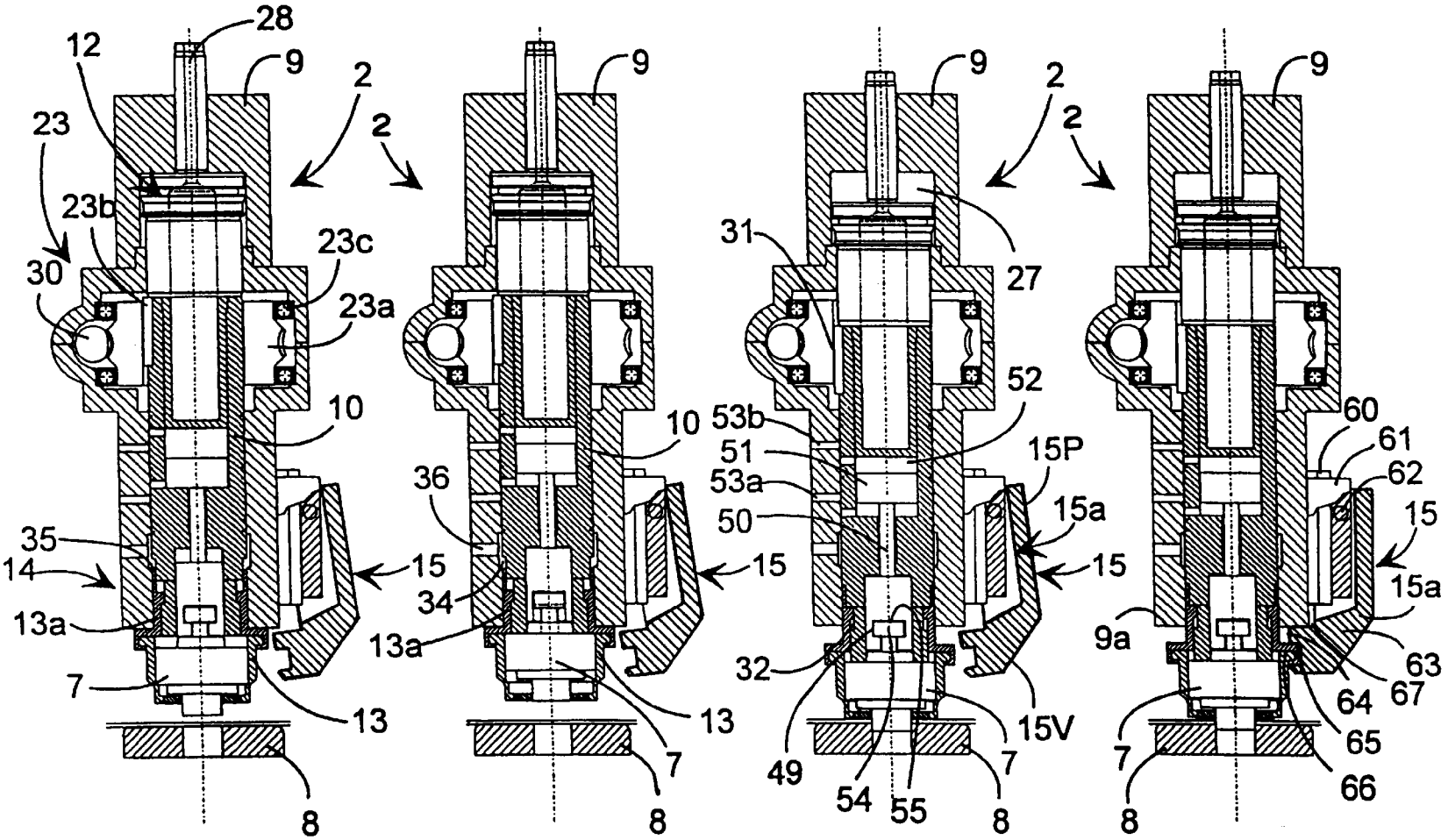
FIG. 3 illustrates the principle of the invention, shown in steps a to d, with the buffer structure according to the second embodiment.

FIG. 3 shows the operation of a second embodiment of the locking arrangement of the invention in the buffer structure 2 of the sheet metal work center. This buffer structure is illustrated in more technical detail with reference to the schematic view of FIG. 2, in steps a to d. FIG. 3*a* shows the position in which the upper tool 7 is above the lower tool 8 and underneath the working level of the releaser 13, the locking arrangement 15 being opened. FIG. 3*b* shows a situation which corresponds substantially to that shown in FIG. 2*c*, FIG. 3*c* shows a situation corresponding to that shown in FIG. 2*d*, and finally FIG. 3*d* shows a situation corresponding to that shown in FIG. 2*e*.

With particular reference to FIGS. 3*a–d*, the buffer 10 is further arranged to be rotatable around the central axis in the longitudinal direction of the buffer structure by means of a rotating device 23 arranged in connection with the buffer structure 2. Between the buffer 10 and the buffer fixing body 9, a tooth wheel rim or a corresponding rotating means 23*a* is mounted on bearings 23*c* on the outer surface of the buffer 10 and driven by a worm pipe or a corresponding driving means 30, which in turn is mounted on bearings on the buffer fixing body 9. This rotating device 23 is used to rotate the buffer 10 in relation to the buffer structure 2 around the vertical axis to achieve the desired angular position of the upper tool 7. Movements of the buffer 10 in the longitudinal direction, such as the working movement, are achieved by pressurized medium supplied via a pressurized medium connector 28 into the pressurized medium space 27 in the punching cylinder 12, wherein the bush-like rotating means, such as the tooth wheel rim 23*a*, surrounding the outer surface of the buffer 10 is arranged in relation to the fixing body 9 of the buffer 10 in a way that the necessary relative movement in the longitudinal direction of the buffer 10 takes place between the inner surface of the rotating means, such as the tooth wheel rim 23*a*, and the outer surface of the upper part of the buffer 10 during working and return movements of the buffer 10 (surface 31). For transmission of the rotating force, a wedge part 23*b* is provided between the parts 10 and 23*a*.

In the lower part of the buffer structure 2, in turn, the transfer device 14 of the releaser 13 is arranged. It consists of a recess in the inner surface of the buffer fixing body 9 in the longitudinal direction of the buffer structure 2 and a collar structure in the lower part of the buffer 10, thus forming a pressurized medium space 34. In a corresponding manner, the bush-like fixing part 13*a* of the releaser 13 is provided with a radial annular front surface 35 facing the pressurized medium space 34. The front surface 35 is movable in the longitudinal direction of the buffer structure 2 in the recess 32 in the buffer 10. With the pressurized medium space 34, a connection 36 for applying through pressurized medium holes or the like to the pressurized medium space 34 are provided, for achieving the different positions.

The upper part of the buffer fixing body 9 is provided with the punching cylinder 12 of the buffer 10, placed in the pressurized medium space 27 in the fixing body. A pressurized medium channel 28 is connected to the pressurized medium space 27.

The lower part of the buffer 10 is provided with an exchange arrangement for the upper tool 7. In connection with the tool exchange arrangement, there is a locking mechanism comprising the combination of a lower chuck 49, a rod 50 and a piston part 51. This combination is placed in corresponding cylindrical holes in the buffer 10 in the longitudinal direction. The upper part of the locking mechanism is placed in pressurized medium space 52, wherein the lower surface of the piston part 51 is acted against by the pressurized medium at a pressure effective through pressurized medium connector 53*a*, which extends through the fixing body 9. The locking mechanism is shown to move to its upper position in FIGS. 3*b–d*. In a corresponding manner, for an effect on the upper surface of the piston part 51 through pressurized medium connector 53*b*, placed in the fixing body 9 and penetrating the same, the locking mechanism moves to its lower position in the longitudinal direction of the buffer 10, wherein the upper tool 7 can be exchanged (FIG. 3*a*). In connection with the upper tool 7, there is a fixing means 54 for fixing the upper tool into the lower chuck 49, at its counterpart 55.

FIG. 3 shows a first embodiment of the locking arrangement 15. Thus the buffer fixing body 9 is provided with a guide 60, the body 61 of the fixing arrangement 15 being arranged to be moved and locked in relation to this guide 60 in the longitudinal direction of the buffer structure 2. In their cross-section, the guide 60 and body 61 form a T-joint. With the body 61, there is a lockpin cam 63 or the like articulated to be rotatable in the vertical direction in relation to the horizontal joint 62. At the tip of the lockpin cam 63, on its horizontal front surface 64, there is a groove or notch 65 which in the so-called passive mode is placed in connection with the ring flange 66 surrounding the outer surface of the fixing part 13*a* of the releaser 13, when the releaser 13 is driven with the buffer structure 10 to the distance of the air gap 19 (FIG. 5) from the lower tool. In the shown embodiment, the groove or notch 65, with its radial front surfaces, is placed against the radial front surfaces of said ring flange 66, on their both sides, to surround the flange 66. Furthermore, the radial surface 67 adjoining the upper edge of the front surface 64 of the lockpin cam 63 is placed against the lower front surface 9*a* of the buffer fixing body 9. In this way the releaser 13 can be coupled with the machine body 1 as a substantially solid piece to receive possible loads in the longitudinal direction of the buffer 10. Thus the locking part 15*a* of the locking arrangement 15, seen in its vertical cross-section, has the primary shape of an L-formed piece whose vertical upper part 15*p* comprises said joint 62 fixed to it, and whose horizontal lower part 15*v* comprises said other parts functional in locking. In a horizontal cross-section, the locking part 15*a* forms a curve which is placed on the outer ring of the ring flange 66, on part of its circumference.

Figure 4:
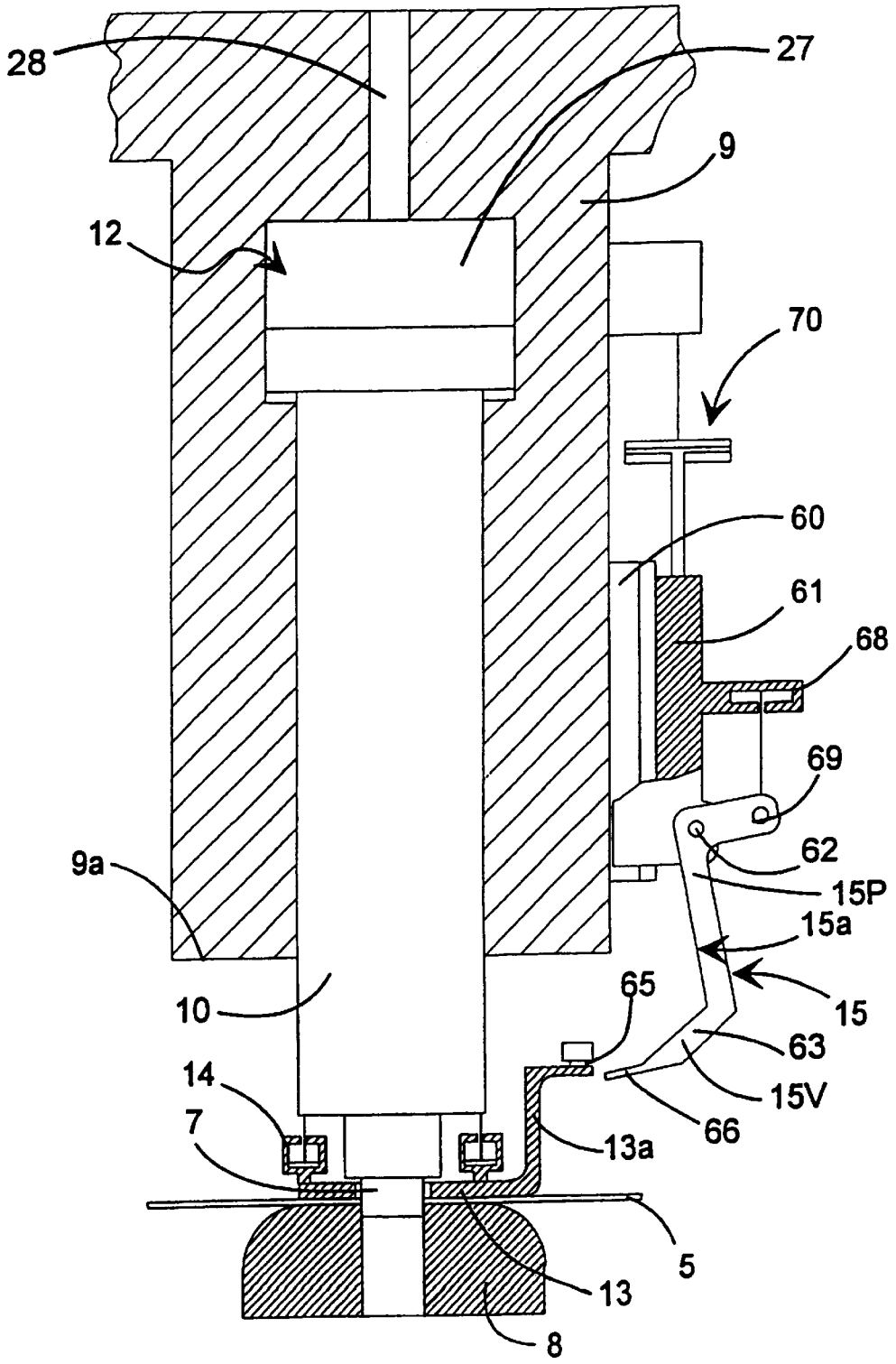
FIG. 4 shows a vertical cross-section of the first embodiment of the buffer structure with the locking arrangement released.
Figure 5:
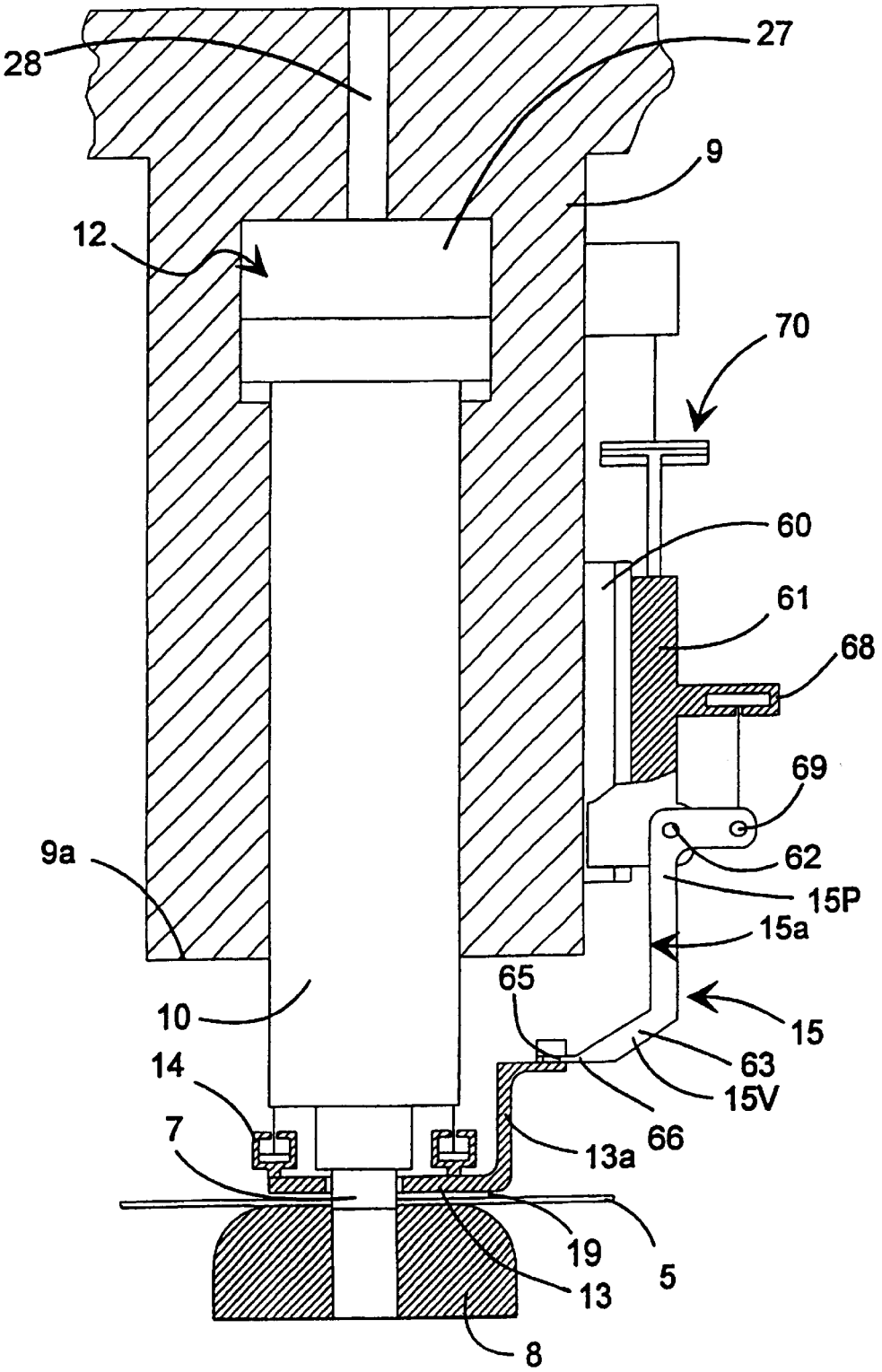
FIG. 5 shows a vertical cross-section with the locking arrangement locked.

Further with reference to FIGS. 4 and 5, a unit comprising substantially the corresponding elements in a different construction is presented in this embodiment. Consequently, the corresponding parts are indicated using the reference numerals of FIG. 3. The locking arrangement 15 and the lockpin cam 63 belonging to its locking part 15*a* are rotated by using an actuator, such as a cylinder-piston mechanism 68, placed in the body 61 and using a pressurized medium, and being connected with the rotatable pin 69 in the locking part 15*a*. Further, the body 61 is provided with a body 60 transfer device 70 for movements in relation to the fixing body of the buffer 9. This transfer device 70, which is an actuator using e.g. pressurized medium, such as a cylinder-piston mechanism, is effective between the buffer transfer body 9 and the body 61. In a corresponding manner, the releaser 13 body 13*a* is in this embodiment provided with a groove 65, in which the tip 66 of the lockpin cam 63 or the like is inserted.

The hydraulic control of the sheet metal work center presented above can be implemented with normal hydraulic components and control mechanisms between them which are known in a way obvious to an expert in the art so that they will not be discussed in this context.

We claim:

1. A method of operating a sheet metal work center having a body, a work table whereon a sheet to be worked is placed, upper and lower tools in punch and stopper structures, respectively, for effecting work on said sheet on its opposite sides, a releaser in operative connection with said upper tool, and a transfer device for moving said upper tool and said releaser in the vertical direction, comprising the steps of:

a) placing a locking arrangement between a stationary part of said punch structure and said releaser; and b) utilizing said transfer device to drive said upper tool and said releaser to move relative to said lower tool (1) in a passive mode with said locking arrangement locked wherein said releaser is at a given distance from the surface of said sheet, or (2) in an active mode with said locking arrangement opened wherein said releaser is in contact with the surface of said sheet.

2. Sheet metal work center comprising:

a body;

a work table whereon a sheet to be worked is placed;

upper and lower tools in punch and stopper structures, respectively, for effecting work on said sheet on its opposite sides;

a releaser working in cooperation with said upper tool;

a transfer device for moving said upper tool and said releaser in the vertical direction; and a locking arrangement placed between a stationary part of said punch structure and said releaser, wherein said upper tool and said releaser are adaptable to be driven by said transfer device to move along said vertical direction, said stationary part of said punch structure and said releaser being connected with said locking arrangement.

3. Sheet metal work center according to claim 2, wherein said upper tool and said releaser are placed in said punch structure, said punch structure including a punch fixing body, said punch structure being mounted in said body of said sheet metal work center.

4. Sheet metal work center according to claim 3, wherein said punch structure includes a chamber; and wherein said locking arrangement is operational between the outer surface of said punch fixing body and a releaser fixing part associated with said releaser on the outer surface of said chamber.

5. Sheet metal work center according to claim 3, wherein said locking arrangement is arranged in the locking position to be supported against the lower front surface of said buffer fixing body.

6. Sheet metal work center according to claim 2, wherein said punch structure includes a chamber, said work center further comprising:

a cushion device placed between said punch and said releaser for moving said releaser in the longitudinal direction of said punch structure in relation to said chamber.

7. Sheet metal work center according to claim 2, wherein said locking arrangement comprises a guide placed in a punch fixing body of said punch structure; and wherein said locking arrangement comprises a body arranged to be moved and locked in relation to said guide in the longitudinal direction of said punch structure.

8. Sheet metal work center according to claim 2, wherein said locking arrangement comprises a locking part movably coupled to a horizontal joint in a body of said locking arrangement, said locking part being pivotable between the open and locked position of said locking arrangement.

9. Sheet metal work center according to claim 8, wherein said releaser comprises a releaser fixing part; and wherein said locking part of said locking arrangement, in its substantially vertical cross-section, is L-shaped, said locking part having a horizontal lower part that is matable with a counterpart of said releaser fixing part.

10. Sheet metal work center according to claim 8, wherein said releaser comprises a releaser fixing part; and wherein the locking of said locking arrangement is effected as a groove-cam locking between said locking part and said releaser fixing part.

11. Sheet metal work center comprising:

a body;

a work table whereon a sheet to be worked is placed;

upper and lower tools in punch and stopper structures, respectively, for effecting work on said sheet on its opposite sides;

a releaser working in cooperation with said upper tool;

a transfer device for moving said upper tool and said releaser in the vertical direction; and a locking arrangement working cooperatively with said releaser, and adaptable to lock said releaser in a position fixedly spaced from the top surface of said sheet as said upper tool is driven by said transfer device to effect work on said sheet.

12. Sheet metal work center of claim 11, wherein said locking arrangement is further adaptable to not lock said releaser in place while said upper tool is driven by said transfer device so that as said upper tool is effecting work on said sheet, said releaser is in contact with the top surface of said sheet.

13. Sheet metal work center of claim 12, wherein said locking arrangement is engaged to said releaser to lock said releaser in place when said work center is in an active mode, and is disengaged from said releaser when said work center is in a passive mode.

14. A method of effecting work in a sheet metal work center having a body, a work table whereon a sheet to be worked is placed, upper and lower tools in punch and stopper structures, respectively, for effecting work on said sheet on its opposite sides, a releaser working in cooperation with said upper tool, and a transfer device for moving said upper tool and said releaser in the vertical direction, comprising the steps of:

a) effecting a locking arrangement to work cooperatively with said releaser; and b) actuating said locking arrangement to (1) lock said releaser in a position fixedly spaced from the top surface of said sheet as said upper tool is driven by said transfer device to effect work on said sheet, or (2) not lock said releaser while said upper tool is driven by said transfer device so that as said upper tool is effecting work on said sheet, said releaser is in contact with the top surface of said sheet.

* * * * *